US007879774B2

(12) United States Patent
Lam et al.

(10) Patent No.: US 7,879,774 B2
(45) Date of Patent: Feb. 1, 2011

(54) TITANIUM-CONTAINING LUBRICATING OIL COMPOSITION

(75) Inventors: William Y. Lam, Glen Allen, VA (US); John T. Loper, Richmond, VA (US); Carl K. Esche, Jr., Richmond, VA (US); Christopher J. Dudding, Reading (GB); Peter Growcott, Hartley Wintney (GB); Anthony Fagan, Chesterfield, VA (US); Andrew Robertson, Faringdon (GB); Gregory H. Guinther, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 996 days.

(21) Appl. No.: 11/611,597

(22) Filed: Dec. 15, 2006

(65) Prior Publication Data

US 2007/0111908 A1 May 17, 2007

Related U.S. Application Data

(63) Continuation-in-part of application No. 10/894,327, filed on Jul. 19, 2004, now Pat. No. 7,615,519, and a continuation-in-part of application No. 11/080,007, filed on Mar. 14, 2005, now Pat. No. 7,615,520.

(51) Int. Cl.
*C10M 129/26* (2006.01)
*C10M 125/00* (2006.01)
*C10M 159/22* (2006.01)
*C10M 159/24* (2006.01)

(52) U.S. Cl. ..... 508/165; 508/418; 508/391; 123/1 A

(58) Field of Classification Search ..... 508/165, 508/391, 418; 123/1 A
See application file for complete search history.

(56) References Cited

U.S. PATENT DOCUMENTS 2,179,125 A 9/1955 Roberts
2,179,126 A 9/1955 Fields et al.
3,017,361 A * 1/1962 Lawrence et al. ..... 508/539
3,087,932 A 4/1963 Lille, Jr.
3,219,666 A 11/1965 Normal et al.
3,539,513 A 11/1970 Forbes et al.
3,565,804 A 2/1971 Honnen et al.
3,697,574 A 10/1972 Piasek et al.
3,736,357 A 5/1973 Piasek et al.
3,821,236 A 6/1974 Ripple
3,904,537 A 9/1975 Ripple
4,097,387 A 6/1978 Caspari
4,107,059 A 8/1978 King et al.
4,136,043 A 1/1979 Davis
4,137,183 A 1/1979 Caspari
4,152,499 A 5/1979 Boerzel et al.
4,164,473 A 8/1979 Coupland et al.
4,176,073 A 11/1979 Ryer et al.
4,176,074 A 11/1979 Coupland et al.
4,188,299 A 2/1980 Caspari
4,192,757 A 3/1980 Brewster
4,193,882 A 3/1980 Gemmill, Jr.
4,210,683 A 7/1980 Praxl et al.
4,234,435 A 11/1980 Meinhardt et al.
4,248,720 A 2/1981 Coupland et al.
4,289,635 A 9/1981 Schroeck
4,479,883 A 10/1984 Shaub et al.
4,490,265 A 12/1984 Holstedt et al.
4,636,322 A 1/1987 Nalesnik
4,702,850 A 10/1987 Gutierrez et al.
4,867,890 A 9/1989 Colclough et al.
4,938,880 A 7/1990 Waddoups et al.
5,000,863 A 3/1991 Watanabe
5,260,466 A 11/1993 McGibbon
5,287,731 A 2/1994 Florkowski et al.
5,387,351 A 2/1995 Kumar et al.
5,401,661 A 3/1995 Florkowski et al.
5,486,300 A 1/1996 Salomon et al.
5,565,528 A * 10/1996 Harrison et al. ..... 525/327.6
5,627,259 A 5/1997 Thaler et al.
5,633,326 A 5/1997 Patil et al.
5,643,859 A 7/1997 Gutierrez et al.
5,756,428 A 5/1998 Emert et al.

(Continued)

FOREIGN PATENT DOCUMENTS

DE 27 02 604 A1 7/1978

(Continued)

OTHER PUBLICATIONS

Dupont Tyzor Organic Titanates General Brochure, 2001, pp. 5-6.*

*Primary Examiner*—Glenn Caldarola
*Assistant Examiner*—Jim Goloboy
(74) *Attorney, Agent, or Firm*—Luedeka, Neely & Graham, P.C.

(57) ABSTRACT

A fully formulated lubricating oil, lubricated surface, and lubricant additive concentrates for lubricants providing reduced sludge formation. The fully formulated lubricating oil composition has therein at least one succinimide dispersant derived from a polyalkylene compound having from about 50 to about 85% vinylidene double bonds in the compound, a metal containing detergent, at least one wear reducing agent, at least one antioxidant, and a hydrocarbon soluble titanium compound as a friction modifier. The lubricating oil composition is also substantially free of molybdenum compounds.

37 Claims, No Drawings

U.S. PATENT DOCUMENTS

| | | | | |
|---|---|---|---|---|
| 5,792,729 | A | 8/1998 | Harrison et al. | |
| 5,792,730 | A | 8/1998 | Gutierrez et al. | |
| 5,851,965 | A | 12/1998 | Harrison et al. | |
| 5,853,434 | A | 12/1998 | Harrison et al. | |
| 5,922,654 | A | 7/1999 | Yamazaki et al. | |
| 6,034,040 | A * | 3/2000 | Ozbalik et al. | 508/469 |
| 6,051,537 | A | 4/2000 | Emert et al. | |
| 6,172,012 | B1 | 1/2001 | Kumar et al. | |
| 6,602,832 | B2 | 8/2003 | Mukkamala et al. | |
| 2005/0153848 | A1 | 7/2005 | Bell et al. | |
| 2006/0014651 | A1 * | 1/2006 | Esche et al. | 508/162 |
| 2006/0116300 | A1 | 6/2006 | Arrowsmith et al. | |
| 2006/0205615 | A1 | 9/2006 | Esche | |
| 2006/0217271 | A1 * | 9/2006 | Brown et al. | 508/165 |

FOREIGN PATENT DOCUMENTS

| | | | |
|---|---|---|---|
| EP | 330 522 | | 12/1994 |
| GB | 0866054 | | 4/1961 |
| GB | 871145 | | 6/1961 |
| GB | 1560830 | | 2/1980 |
| JP | 61-111397 | | 5/1986 |
| JP | 03-190997 | A | 8/1991 |
| JP | 10-259392 | A | 9/1998 |
| JP | 11-131084 | A | 5/1999 |
| JP | 2002-302691 | | 10/2002 |
| JP | 2004-182829 | A | 7/2004 |
| SU | 1669975 | A | 8/1991 |

* cited by examiner

TITANIUM-CONTAINING LUBRICATING OIL COMPOSITION

RELATED APPLICATIONS

This application is a continuation-in-part of Ser. No. 10/894,327, filed Jul. 19, 2004, now U.S. Pat. No. 7,615,519, issued Nov. 10, 2009, and is a continuation-in-part of Ser. No. 11/080,007, filed Mar. 14, 2005, now U.S. Pat. No. 7,615,520, issued Nov. 10, 2009.

TECHNICAL FIELD

The disclosure relates to lubricating oil compositions. More particularly, the disclosure relates to lubricating oil compositions including titanium-containing compounds for improved lubricating performance properties.

BACKGROUND AND SUMMARY

Lubricating oil compositions used to lubricate internal combustion engines contain a base oil of lubricating viscosity, or a mixture of such oils, and additives used to improve the performance characteristics of the oil. For example, additives are used to improve detergency, to reduce engine wear, to provide stability against heat and oxidation, to reduce oil consumption, to inhibit corrosion, to act as a dispersant, and to reduce friction loss. Some additives provide multiple benefits, such as dispersant-viscosity modifiers. Other additives, while improving one characteristic of the lubricating oil, have an adverse effect on other characteristics. Thus, to provide lubricating oil having optimal overall performance, it is necessary to characterize and understand all the effects of the various additives available, and carefully balance the additive content of the lubricant.

It has been proposed in many patents and articles (for example, U.S. Pat. Nos. 4,164,473; 4,176,073; 4,176,074; 4,192,757; 4,248,720; 4,201,683; 4,289,635; and 4,479,883) that oil-soluble molybdenum compounds are useful as lubricant additives. In particular, the addition of molybdenum compounds to oil, particularly molybdenum dithiocarbamate compounds, provide the oil with improved boundary friction characteristics and bench tests demonstrate that the coefficient of friction of oil containing such molybdenum compounds is generally lower than that of oil containing organic friction modifiers. This reduction in coefficient of friction results in improved antiwear properties and may contribute to enhanced fuel economy in gasoline or diesel fired engines, including both short- and long-term fuel economy properties (i.e., fuel economy retention properties). To provide antiwear effects, molybdenum compounds are generally added in amounts introducing from about 350 ppm up to 2,000 ppm of molybdenum into the oil. While molybdenum compounds are effective antiwear agents and may further provide fuel economy benefits, such molybdenum compounds are expensive relative to more conventional, metal-free (ashless) organic friction modifiers.

Despite the foregoing, there continues to be a need for more cost effective lubricant compositions that provide equivalent or superior performance to lubricant compositions without the presence of molybdenum-based friction modifiers.

In accordance with a first aspect, one exemplary embodiment of the disclosure provides an improved lubricating oil composition substantially devoid of molybdenum compounds that may provide equivalent or superior lubricating properties. The lubricating oil composition has therein at least one succinimide dispersant derived from a polyalkylene compound having from about 50 to about 85% vinylidene double bonds in the compound. A metal containing detergent, at least one wear reducing agent, at least one antioxidant, and a hydrocarbon soluble titanium compound as a friction modifier are also included in the lubricating oil. The lubricating oil composition is substantially free of molybdenum compounds.

In accordance with a second aspect, the disclosure provides a lubricant additive concentrate for reducing sludge in a lubricant composition. The concentrate is devoid of molybdenum and contains a hydrocarbyl carrier fluid, at least one succinimide dispersant derived from a polyalkylene compound having from about 50 to about 85% vinylidene double bonds in the compound. Also included in the concentrate is a hydrocarbon soluble titanium compound as a friction modifier providing from about 10 to about 500 ppm titanium to the lubricant composition.

In accordance with a third aspect, the disclosure provides a lubricated surface having a lubricant composition containing a base oil of lubricating viscosity and an additive package in contact therewith. The additive package includes at least one succinimide dispersant derived from a polyalkylene compound having from about 50 to about 85% vinylidene double bonds in the compound. Also included in the additive packages is a metal containing detergent, at least one wear reducing agent, at least one antioxidant, and a hydrocarbon soluble titanium compound as a friction modifier. The lubricant compostion in contact with the surface is substantially free of molybdenum compounds.

Yet another aspect of the disclosure provides a fully formulated lubricant composition including a base oil component of lubricating viscosity and an amount of sludge reducing lubricant additive. The lubricant additive contains at least one succinimide dispersant derived from a polyalkylene compound having from about 50 to about 85% vinylidene double bonds in the compound, a metal containing detergent, at least one wear reducing agent, at least one antioxidant, and a hydrocarbon soluble titanium compound as a friction modifier providing from about 10 to about 500 ppm titanium to the lubricant composition. The lubricant composition is also substantially free of molybdenum compounds.

Still another aspect of the disclosure provides a lubricant composition containing a base oil of lubricating viscosity and an amount of at least one hydrocarbon soluble titanium compound effective to provide improved lubricant properties selected from a reduction in surface wear greater than a surface wear of a lubricant composition devoid of the hydrocarbon soluble titanium compound, a reduction in oxidation of the lubricant composition greater than a reduction in oxidation of the lubricant composition devoid of the hydrocarbon soluble titanium compound, and a reduction in sludge formation in the lubricant composition greater than a reduction in sludge formation in the lubricant composition devoid of the hydrocarbon soluble titanium compound.

One advantage of the disclosed embodiments is a significant improvement in sludge reduction over compositions containing titanium compounds and conventional succinimide dispersants. The foregoing advantage is obtained despite the absence of molybdenum containing compounds in the lubricant composition. Other advantages may include a reduction in a coefficient of friction, a reduction in surface wear, and/or a reduction in oxidation of the lubricant composition. Other and further objects, advantages and features of the disclosed embodiments may be understood by reference to the following.

DESCRIPTION OF THE EXEMPLARY EMBODIMENTS

For the lubricating oil compositions disclosed herein, any suitable hydrocarbon-soluble titanium compound having friction modifying and/or extreme pressure, and/or antioxidant, and/or anti-wear properties in lubricating oil compositions may be used and/or sludge reducing properties alone or in combination with other additives. The terms "hydrocarbon soluble," "oil soluble," or "dispersable" are not intended to indicate that the compounds are soluble, dissolvable, miscible, or capable of being suspended in a hydrocarbon compound or oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The term "hydrocarbon soluble" means that the compound is substantially suspended or dissolved in a hydrocarbon material, as by reaction or complexation of a magnesium compound with a hydrocarbon material. As used herein, "hydrocarbon" means any of a vast number of compounds containing carbon, hydrogen, and/or oxygen in various combinations.

The term "hydrocarbyl" refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(ii) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(iii) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Importantly, the organo groups of the ligands have a sufficient number of carbon atoms to render the compound soluble or dispersible in the oil or hydrocarbon fluid. For example, the number of carbon atoms in each group will generally range between about 1 to about 100, preferably from about 1 to about 30, and more preferably between about 4 to about 20.

The hydrocarbon soluble titanium compounds suitable for use as a herein, for example as a friction modifier, extreme pressure agent, or antioxidant are provided by a reaction product of a titanium alkoxide and an about $C_6$ to about $C_{25}$ carboxylic acid. The reaction product may be represented by the following formula:

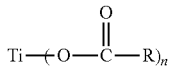

wherein n is an integer selected from 2, 3 and 4, and R is a hydrocarbyl group containing from about 5 to about 24 carbon atoms, or by the formula:

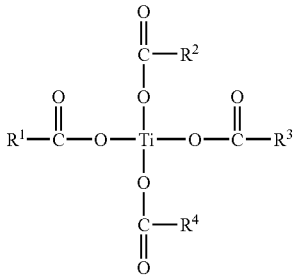

wherein each of $R^1$, $R^2$, $R^3$, and $R^4$ are the same or different and are selected from a hydrocarbyl group containing from about 5 to about 25 carbon atoms. Compounds of the foregoing formulas are essentially devoid of phosphorous and sulfur.

In an embodiment, the hydrocarbon soluble titanium compound may be substantially or essentially devoid or free of sulfur and phosphorus atoms such that a lubricant or formulated lubricant package comprising the hydrocarbon soluble titanium compound contains about 0.7 wt. % or less sulfur and about 0.12 wt. % or less phosphorus.

In another embodiment, the hydrocarbon soluble titanium compound may be substantially free of active sulfur. "Active" sulfur is sulfur which is not fully oxidized. Active sulfur further oxidizes and becomes more acidic in the oil upon use.

In yet another embodiment, the hydrocarbon soluble titanium compound may be substantially free of all sulfur. In a further embodiment. the hydrocarbon soluble titanium compound may be substantially free of all phosphorus. In a still further embodiment, the hydrocarbon soluble titanium compound may be substantially free of all sulfur and phosphorus. For example, the base oil in which the titanium compound may be dissolved in may contain relatively small amounts of sulfur, such as in one embodiment, less than about 0.5 wt % and in another embodiment, about 0.03 wt % or less sulfur (e.g., for Group II base oils), and in a still further embodiment, the amount of sulfur and/or phosphorus may be limited in the base oil to an amount which permits the finished oil to meet the appropriate motor oil sulfur and/or phosphorus specifications in effect at a given time.

Examples of titaniumicarboxylic acid products include, but are not limited to, titanium reaction products with acids selected from the group consisting essentially of caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic aicd, neodecanoic acid, and the like. Methods for making such titanium/carboxylic acid products are described, for example, in U.S. Pat. No. 5,260,466, the disclosure of which is incorporated herein by reference.

The following examples are given for the purpose of exemplifying aspects of the embodiments and are not intended to limit the embodiments in any way.

EXAMPLE 1

Synthesis of Titanium Neodecanoate

Neodecanoic acid (about 600 grams) was placed into a reaction vessel equipped with a condenser Dean-Stark trap, thermometer, thermocouple, and a gas inlet. Nitrogen gas was bubbled into the acid. Titanium isopropoxide (about 245 grams) was slowly added to the reaction vessel with vigorous stirring. The reactants were heated to about 140° C. and stirred for one hour. Overheads and condensate from the reaction were collected in the trap. A subatmospheric pressure was applied to the reaction vessel and the reactants were stirred for about an additional two hours until the reaction was complete. Analysis of the product indicated that the product had a kinematic viscosity of about 14.3 cSt at about 100° C. and a titanium content of about 6.4 percent by weight.

EXAMPLE 2

Synthesis of Titanium Oleate

Oleic acid (about 489 grams) was placed into a reaction vessel equipped with a condenser, Dean-Stark trap, thermometer, thermocouple, and a gas inlet. Nitrogen gas was bubbled into the acid. Titanium isopropoxide (about 122.7 grams) was slowly added to the reaction vessel with vigorous stirring. The reactants were heated to about 140° C. and stirred for one hour. Overheads and condensate from the reaction were collected in the trap. A subatmospheric pressure was applied to the reaction vessel and the reactants were stirred for about an additional two hours until the reaction was complete. Analysis of the product indicated that the product had a kinematic viscosity of about 7.0 cSt at about 100° C. and a titanium content of about 3.8 percent by weight.

The hydrocarbon soluble titanium compounds of the embodiments described herein are advantageously incorporated into lubricating compositions. Accordingly, the hydrocarbon soluble titanium compounds may be added directly to the lubricating oil composition. In one embodiment, however, hydrocarbon soluble titanium compounds are diluted with a substantially inert, normally liquid organic diluent such as mineral oil, synthetic oil (e.g., ester of dicarboxylic acid), naptha, alkylated (e.g., $C_{10}$-$C_{13}$ alkyl) benzene, toluene or xylene to form a metal additive concentrate. The titanium additive concentrates usually contain from about 0% to about 99% by weight diluent oil.

The lubricating compositions of the disclosed embodiment contain the titanium compound in an amount providing the compositions with at least 1 ppm of titanium. For example, an amount of at least 10 ppm of titanium from a titanium compound has been found to be effective to provide friction modification alone or in combination with a second friction modifier selected from nitrogen containing friction modifiers; organic polysulfide friction modifiers; amine-free friction modifiers, and organic, ashless, nitrogen-free friction modifiers.

Desirably, the titanium from a titanium compound is present in an amount of from about 10 ppm to about 1500 ppm, such as 10 ppm to 1000 ppm, more desirably from about 50 ppm to 500 ppm, and still more desirably in an amount of from about 75 ppm to about 250 ppm, based on the total weight of the lubricating composition. Because such titanium compounds may also provide antiwear credits to lubricating oil compositions, the use thereof allows for a reduction in the amount of metal dihydrocarbyl dithiophosphate antiwear agent (e.g., ZDDP) employed. Industry trends are leading to a reduction in the amount of ZDDP being added to lubricating oils to reduce the phosphorous content of the oil to below 1000 ppm, such as to 250 ppm to 750 ppm, or 250 ppm to 500 ppm. To provide adequate wear protection in such low phosphorous lubricating oil compositions, the titanium compound should be present in an amount providing at least 50 ppm by mass of titanium. The amount of titanium and/or zinc may be determined by Inductively Coupled Plasma (ICP) emission spectroscopy using the method described in ASTM D5185.

In a similar manner, the use of the titanium compounds in lubricating compositions may facilitate the reduction of antioxidant and extreme pressure agents in the lubricating compositions.

Dispersants

Another important component of lubricant compositions having reduced sludge tendencies is at least one dispersant derived from a highly reactive polyalkylene compound. The polyalkylene compound may have a number average molecular weight ranging from about 400 to about 5000 or more. The term "highly reactive" means that a number of residual vinylidene double bonds in the compound is greater than about 45%. For example, the number of residual vinylidene double bonds may range from about 50 to about 85% in the compound. The percentage of residual vinylidene double bonds in the compound may be determined by well-known methods, such as for example Infra-Red Spectroscopy or $C_{13}$ Nuclear Magnetic Resonance or a combination thereof. A process for producing such compounds is described, for example, in U.S. Pat. No. 4,152,499. A particularly suitable compound is a polyisobutene having a ratio of weight average molecular weight to number average molecular weight ranging from about 1 to about 6.

Dispersants which may be used include, but are not limited to, amine, alcohol, amide, or ester polar moieties attached to the polymer backbone often via a bridging group. Dispersants may be selected from Mannich dispersants as described, for example, in U.S. Pat. Nos. 3,697,574 and 3,736,357; ashless succcinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

A particularly suitable dispersant is a polyalkylene succinimide dispersant derived from the polyisobutene (PIB) compound described above wherein the dispersant has a reactive PIB content of at least about 45%. A particularly suitable dispersant is a mixture of dispersants having number average molecular weights ranging from about 800 to about 3000 and reactive PIB contents of from about 50 to about 60%. The total amount of dispersant in the lubricant composition may range from about 1 to about 10 percent by weight of the total weight of the lubricant composition.

Friction Modifiers

An oil soluble friction modifier, other than the titanium compound described above, may be incorporated in the lubricating oil compositions described herein as a second friction modifier. The second friction modifier may be selected from nitrogen-containing, nitrogen-free and/or amine free friction modifiers. Typically, the second friction modifier may be used in an amount ranging from about 0.02 to 2.0 wt. % of the lubricating oil composition. Desirably, from 0.05 to 1.0, more desirably from 0.1 to 0.5, wt. % of the second friction modifier is used.

Examples of such nitrogen containing friction modifiers that may be used include, but are not limited to, imidazolines, amides, amines, succinimides, alkoxylated amines, alkoxylated ether amines, amine oxides, amidoamines, nitrites, betaines, quaternary amines, imines, amine salts, amino guanadine, alkanolamides, and the like.

Such friction modifiers may contain hydrocarbyl groups that may be selected from straight chain branched chain or aromatic hydrocarbyl groups or admixtures thereof, and may be saturated or unsaturated. Hydrocarbyl groups are predominantly composed of carbon and hydrogen but may contain one or more hetero atoms such as sulfur or oxygen. Preferred hydrocarbyl groups range from 12 to 25 carbon atoms and may be saturated or unsaturated. More preferred are those with linear hydrocarbyl groups.

Exemplary friction modifiers include amides of polyamines. Such compounds may have hydrocarbyl groups that are linear, either saturated or unsaturated or a mixture thereof and contain no more than about 12 to about 25 carbon atoms.

Other exemplary friction modifiers include alkoxylated amines and alkoxylated ether amines, with alkoxylated amines containing about two moles of alkylene oxide per mole of nitrogen being the most preferred. Such compounds can have hydrocarbyl groups that are linear, either saturated, unsaturated or a mixture thereof. They contain no more than about 12 to about 25 carbon atoms and may contain one or more hetero atoms in the hydrocarbyl chain. Ethoxylated amines and ethoxylated ether amines are particularly suitable nitrogen-containing friction modifiers. The amines and amides may be used as such or in the form of an adduct or reaction product with a boron compound such as a boric oxide, boron halide, metaborate, boric acid or a mono-, di- or tri-alkyl borate.

The ashless organic polysulfide compounds that may be used as friction modifiers include organic compounds expressed by the following formulae, such as sulfides of oils or fats or polyolefins, in which a sulfur atom group having two or more sulfur atoms adjoining and bonded together is present in a molecular structure.

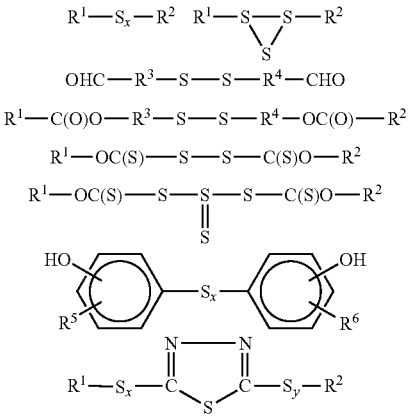

In the above formulae, $R^1$ and $R^2$ independently denote a straight-chain, branched-chain, alicyclic or aromatic hydrocarbon group in which a straight chain, a branched chain, an alicyclic unit and an aromatic unit may be selectively contained in any combined manner. An unsaturated bond may be contained, but a saturated hydrocarbon group is desirable. Among them, alkyl group, aryl group, alkylaryl group, benzyl group, and alkytbenzyl group are particularly desired.

$R^2$ and $R^3$ independently denote a straight-chain, branched-chain alicyclic or aromatic hydrocarbon group which has two bonding sites and in which a straight chain, a branched chain, an alicyclic unit and an aromatic unit may be selectively contained in any combined manner. An unsaturated bond may be contained, but a saturated hydrocarbon group is desirable. Among them, an alkylene group is particularly desirable.

$R^5$ and $R^6$ independently denote a straight-chain or branched-chain hydrocarbon group. The subscripts "x" and "y" denote independently an integer of two or more.

Specifically, for example, mention may be made of sulfurized sperm oil, sulfurized pinene oil, sulfurized soybean oil, sulfurized polyolefin, dialkyl disulfide, dialkyl polysulfide, dibenzyl disulfide, di-tertiary butyl disulfide, polyolefin polysulfide, thiadiazole type compound such as bis-alkyl polysulfanyl thiadiazole, and sulfurized phenol. Among these compounds, dialkyl polysulfide, dibenzyl disulfide, and thiadiazole type compound are desirable. Particularly desirable is bis-alkyl polysulfanyl thiadiazole.

As the lubricant additive, a metal-containing compound such as Ca phenate having a polysulfide bond may be used. However, since this compound has a large coefficient of friction, use of such compound may not always be suitable. To the contrary, the above organic polysulfide compound may be an ashless compound containing no metal, and exhibits excellent performance in maintaining a low coefficient of friction for a long time when used in combination other friction modifiers.

The above ashless organic polysulfide compound (hereinafter referred to briefly as "polysulfide compound") is added in an amount of 0.01 to 0.4wt %, typically 0.1-0.3 wt %, and desirably 0.2-0.3 wt %, when calculated as sulfur (S), relative to the total amount of the lubricant composition. If the addition amount is less than 0.01 wt %, it is difficult to attain the intended effect, whereas if it is more than 0.4 wt %, there is a danger that corrosive wear increase.

Organic, ashless (metal-free), nitrogen-free friction modifiers which may be used in the lubricating oil compositions disclosed herein are known generally and include esters formed by reacting carboxylic acids and anhydrides with alkanols or glycols, with fatty acids being particularly suitable carboxylic acids. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. A particularly desirable friction modifier to use in combination with the titanium compound is an ester such as glycerol monooleate (GMO).

The second friction modifier described above that may be included in the lubricating oil compositions disclosed herein an amount effective to allow the composition to reliably pass a Sequence VG test in combination with the titanium compound. For example, the second friction modifier may be added to the titanium-containing lubricating oil composition in an amount sufficient to obtain a average engine sludge rating of greater than about 8.2 and an oil screen clogging rating of less than about 20%. Typically, to provide the desired effect, the second friction modifier may be added in an amount of from about 0.25 wt. % to about 2.0 wt. % (AI), based on the total weight of the lubricating oil composition.

Metal-Containing Detergent

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Known detergents include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from about 20 to about 450 TBN, and neutral and overbased calcium phenates and sulfurized phenates having TBN of from about 50 to about 450.

In the disclosed embodiments, one or more calcium-based detergents may be used in an amount introducing from about 0.05 to about 0.6 wt. % calcium, sodium, or magnesium into the composition. The amount of calcium, sodium, or magnesium may be determined by Inductively Coupled Plasma (ICP) emission spectroscopy using the method described in ASTM D5185. Typically, the metal-based detergent is overbased and the total base number of the overbased detergent ranges from about 150 to about 450. More desirable, the metal-based detergent is an overbased calcium sulfonate detergent. The compositions of the disclosed embodiments may further include either neutral or overbased magnesium-based detergents, however, typically, the lubricating oil compositions disclosed herein are magnesium free.

Antiwear Agents

Metal dihydrocarbyl dithiophosphate antiwear agents that may be added to the lubricating oil composition of the present invention comprise dihydrocarbyl dithiophosphate metal salts wherein the metal may be an alkali or alkaline earth metal, or aluminum, lead, tin, molybdenum, manganese, nickel, copper, titanium, or zinc. The zinc salts are most commonly used in lubricating oils.

Dihydrocarbyl dithiophosphate metal salts may be prepared in accordance with known techniques by first forming a dihydrocarbyl dithiophosphoric acid (DDPA), usually by reaction of one or more alcohol or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids may be prepared where the hydrocarbyl groups on one are entirely secondary in character and the hydrocarbyl groups on the others are entirely primary in character. To make the metal salt, any basic or neutral metal compound may be used but the oxides, hydroxides and carbonates are most generally used. Commercial additives frequently contain an excess of metal due to the use of an excess of the basic metal compound in the neutralization reaction.

The zinc dihydrocarbyl dithiophosphates (ZDDP) that are typically used are oil soluble salts of dihydrocarbyl dithiophosphoric acids and may be represented by the following formula:

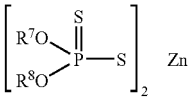

wherein $R^7$ and $R^8$ may be the same or different hydrocarbyl radicals containing from 1 to 18, typically 2 to 12, carbon atoms and including radicals such as alkyl, alkenyl, aryl, arylalkyl, alkaryl and cycloaliphatic radicals. Particularly desired as $R^7$ and $R^8$ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. $R^7$ and $R^8$) in the dithiophosphoric acid will generally be about 5 or greater. The zinc dihydrocarbyl dithiophosphate can therefore comprise zinc dialkyl dithiophosphates.

In order to limit the amount of phosphorus introduced into the lubricating oil composition by ZDDP to no more than 0.1 wt. % (1000 ppm), the ZDDP should desirably be added to the lubricating oil compositions in amounts no greater than from about 1.1 to 1.3 wt. %, based upon the total weight of the lubricating oil composition.

Other additives, such as the following, may also be present in lubricating oil compositions disclosed herein.

Viscosity Modifiers

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Oxidation Inhibitors

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having $C_5$ to $C_{12}$ alkyl side chains, calcium nonylphenol sulfide, ashless oil soluble phenates and sulfurized phenates, phosphosulirized or sulfurized hydrocarbons, phosphorus esters, metal thiocarbamates and oil soluble copper compounds as described in U.S. Pat. No. 4,867,890.

Rust Inhibitors

Rust inhibitors selected from the group consisting of nonionic polyoxyalkylene polyols and esters thereof, polyoxyalkylene phenols, and anionic alkyl sulfonic acids may be used.

Corrosion Inhibitors

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043, 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are typically present in an amount not exceeding 0.2 wt. % active ingredient.

Demulsifying Agent

A small amount of a demulsifying component may be used. A suitable demulsifying component is described in EP 330,522. The demulsifying component may be made by reacting an alkylene oxide with an adduct obtained by reacting a bis-epoxide with a polyhydric alcohol. The demulsifying component may be used at a level not exceeding 0.1 mass % active ingredient. A treat rate of 0.001 to 0.05 mass % active ingredient is convenient.

Pour Point Depressants

Pour point depressants, otherwise known as lube oil flow improvers, lower the minimum temperature at which the fluid will flow or can be poured. Such additives are well known. Typical of those additives which improve the low temperature fluidity of the fluid are $C_3$ to $C_{18}$ dialkyl fumarate/vinyl acetate copolymers, polyalkylmethacrylates and the like.

Antifoam Agents

Foam control can be provided by many compounds including an antifoamant of the polysiloxane type, for example, silicone oil or polydimethyl siloxane.

Some of the above-mentioned additives may provide a multiplicity of effects; thus for example, a single additive may act as a dispersant-oxidation inhibitor. This approach is well known and does not require further elaboration.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Base Oil

The oil of lubricating viscosity used as a base oil may be at least one oil selected from the group consisting of Group I, Group II, and/or Group III base stocks or base oil blends of the aforementioned base stocks provided that the viscosity index of the base oil or base oil blend is at least 95 and allows for the formulation of a lubricating oil composition having a Noack volatility, measured by determining the evaporative loss in mass percent of an oil after 1 hour at 250° C. according to the procedure of ASTM D5880, of less than 15%. In addition, the oil of lubricating viscosity may be one or more Group IV or Group V base stocks or combinations thereof or base oil mixtures containing one or more Group IV or Group V base stocks in combination with one or more Group I, Group II and/or Group III base stocks. Other base oils may include at least a portion comprising a base oil derived from a gas to liquid process.

The most desirable base oils for meeting current ILSAC GF-4 and API SM specifications, are:

(a) Base oil blends of Group III base stocks with Group I or Group II base stocks, where the combination has a viscosity index of at least 110; or (b) Group III, IV or V base stocks or base oil blends of more than one Group III, IV or V base stocks, where the viscosity index is between about 120 to about 140.

Definitions for the base stocks and base oils in disclosure are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks containing less than 90 percent saturates and/or greater than 0.03 percent sulfiir and having a viscosity index greater than or equal to 80 and less than 120 using the test methods specified in Table 1.

b) Group II base stocks containing greater than or equal to 90 percent saturates and less than or equal to 0.03 percent sulfur and having a viscosity index greater than or equal to 80 and less than 120 using the test methods specified in Table 1.

c) Group III base stocks containing greater than or equal to 90 percent saturates and less than or equal to 0.03 percent sulfur and having a viscosity index greater than or equal to 120 using the test methods specified in Table 1.

d) Group IV base stocks that are polyalphaolefins (PAO).

e) Group V base stocks that include all other base stocks not included in Group I, II, III, or IV.

TABLE 1

Analytical Methods for Base Stock

| Property | Test Method |
|---|---|
| Saturates | ASTM D 2007 |
| Viscosity Index | ASTM D 2270 |
| Sulfur | ASTM D 2662, ASTM D 4294<br>ASTM D 4927, ASTM D 3120 |

Preferably, all the additives except for the viscosity modifier and the pour point depressant are blended into a concentrate or additive package described herein as an additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final lubricating oil formulation may employ from about 2 to about 20 mass %, typically from about 4 to about 18 mass %, and desirably from about 5 to about 17 mass % of the concentrate or additive package with the remainder being base stock.

EXAMPLE 3

In order to evaluate the sludge reducing effect of a lubricant composition made according to the disclosed embodiments, a Sequence VG engine test was conducted. The Sequence VG test is a replacement test for Sequence VE, ASTM D 5302, sludge and varnish. The Sequence VG test measures a motor oil's ability to inhibit sludge and varnish fornation. The engine was a fuel-injected gasoline engine, with roller followers, coolant-jacketed rocker covers, and camshaft baffles. The test was conducted on each oil for 216 hours and involved 54 cycles each with three different operating stages. At the end of each test, sludge deposits on rocker arm covers, cam baffles, timing chain cover, oil pan and oil pan baffle, valve decks was determined. Varnish deposits were determined for piston skirts and cam baffles. Sludge clogging was determined for the oil pump screen and the piston oil rings. Inspections were also conducted for "hot" and "cold" stuck piston compression rings.

The base oil for each run was a mixture of Group I and Group II oils suitable of making SAE 5W-30 viscosity grade. A control run (Run 1) in the Sequence VG engine test was run with a fully formulated lubricant containing a conventional dispersant mixture and titanium-containing additive. A second run (Run 2) was made with a lubricant composition containing a dispersant mixture derived from a highly reactive polyisobutylene (HRPIB) and the titanium-containing additive to demonstrate the effectiveness of the combination of the HRPIB dispersant and titanium-containing additive on a reduction in engine sludge. The treatment levels of HRPIB dispersant in Run 1 were adjusted to impart equivalent amounts of neat dispersants as the amount of neat dispersants in Run 2.

TABLE 2

Lubricant Compositions

| Lubricant Formulation | Run 1 Amount (wt. %) | Run 2 Amount (wt. %) |
|---|---|---|
| Conventional Succinimide 1 | 2.06 | — |
| Conventional Succinimide 2 | 2.82 | — |
| High Reactive PIB derived Succinimide 1 | — | 2.15 |
| High Reactive PIB derived Succinimide 2 | — | 2.35 |

The dispersant system described herein may be used in combination with other additives. The other additives are typically blended into the base oil in an amount that enables that additive to provide its desired fuinction. Representative effective amounts of such additives, when used in crankcase lubricants, are listed below. All the values listed are stated as weight percent active ingredient.

| Additive | Wt. % (Broad) | Wt. % (Preferred) |
|---|---|---|
| Antioxidant system | 0-5 | 0.01-3 |
| Metal Detergents | 0.1-15 | 0.2-8 |
| Corrosion Inhibitor | 0-5 | 0-2 |
| Metal Dihydrocarby Dithiophosphate | 0.1-6 | 0.1-4 |
| Antifoaming Agent | 0-5 | 0.001-0.15 |
| Friction Modifier | 0-5 | 0-2 |
| Supplemental Antiwear Agents | 0-1.0 | 0-0.8 |
| Pour Point Depressant | 0.01-5 | 0.01-1.5 |

-continued

| Additive | Wt. % (Broad) | Wt. % (Preferred) |
|---|---|---|
| Viscosity Modifier | 0.01-10 | 0.25-7 |
| Basestock | Balance | Balance |

Analytical results and engine tests results of formulations containing the conventional succinimide mixtures and the succinimide mixtures according to the disclosure are provided in the following tables 3 and 4.

TABLE 3

Analytical Data

| | Run 1 | Run 2 |
|---|---|---|
| Phosphorus, wt % | 0.076 | 0.074 |
| Calcium, wt % | 0.21 | 0.21 |
| Zinc, wt % | 0.086 | 0.088 |
| Boron, wt % | 0.016 | 0.020 |
| Titanium, ppm | 54 | 53 |

TABLE 4

Sequence VG Test Results

| | Run 1 | Run 2 |
|---|---|---|
| Average engine sludge (7.8 minimum) | 8.19 | 8.98 |
| Rocker cover sludge (8.0 minimum) | 9.45 | 9.73 |
| Average engine varnish (8.9 minimum) | 9.14 | 9.11 |
| Piston skirt varnish (7.5 minimum) | 8.14 | 7.86 |
| Oil screen (sludge) clogging (20% maximum) | 40 | 9 |
| Hot stuck compression rings (none) | 0 | 0 |

The Sequence VG test result obtained from Run 2 showed significant improvements in the average engine sludge and oil screen clogging ratings over the test results obtained by Run 1. The applicability of the HRPIB dispersant and Ti additive for engine sludge reduction is not limited to the composition shown in this example. Accordingly, fully formulated lubricant composition containing the titanium additive in a Group I oil may include Group II, Group II+, Group III, and Group IV, base oils and mixtures thereof. It is believed that the disclosed embodiments may enable significant improvement in engine sludge reduction.

EXAMPLE 4

Antioxidant Effects of Hydrocarbon Soluble Titanium Additives

In the following examples, hydrocarbon soluble titanium compounds were added as a top treat to a preblend lubricant composition to provide titanium metal in amounts ranging from about 50 to about 830 ppm in the finished lubricant. The preblend used was a prototype passenger car engine oil formulated in Group III basestock that contained conventional amounts of detergents, dispersants, pour point depressants, friction modifiers, antioxidants, and viscosity index improvers and was devoid of titanium metal.

The oxidation stability of oils formulated with from about 0 to about 800 parts per million in terms of elemental titanium were evaluated using a TEOST MHT-4 test. The TEOST MHT-4 test is a standard lubricant industry test for the evaluation of the oxidation and carbonaceous deposit-forming characteristics of engine oils. The test is designed to simulate high temperature deposit formation in the piston ring belt area of modem engines. The test uses a patented instrument (U.S. Pat. Nos. 5,401,661 and 5,287,731; the substance of each patent is hereby incorporated by reference) with the MHT-4 protocol being a relatively new modification to the test. Details of the test operation and specific MHT-4 conditions have been published by Selby and Florkowski in a paper entitled, "The Development of the TEOST Protocol MHT as a Bench Test of Engine Oil Piston Deposit Tendency" presented at the 12$^{th}$ International Colloquium Technische Akademie Esslingen, Jan. 11-13, 2000, Wilfried J. Bartz editor. In general, the lower the milligrams of deposit, the better the additive.

TABLE 5

TEOST Test Results for the Oil of Table 1 Top Treated with Titanium Neodecanoate

| Sample No. | Oil in blend (wt. %) | Ti-neodecanoate (wt. %) | Ti metal (ppm) | TEOST (milligrams) |
|---|---|---|---|---|
| 1 | 100 | 0 | 0 | 39.4 |
| 2 | 99.92 | 0.08 | 51 | 29.9 |
| 3 | 99.84 | 0.16 | 101 | 22.3 |
| 4 | 99.68 | 0.32 | 208 | 22.8 |
| 5 | 99.36 | 0.64 | 410 | 33.0/29.6 |
| 6 | 99.04 | 0.96 | 621 | 21.2 |
| 7 | 98.72 | 1.28 | 822 | 27.9 |

In the foregoing Table 5, the oxidation stability of samples 2-7 containing the indicated amounts of titanium neodecanoate were compared with the oxidation stability of the base oil (sample 1) used in samples 2-7. As indicated by the data, there is a dramatic increase in oxidation stability for oils containing from about 50 to about 800 ppm titanium metal.

TABLE 6

TEOST Test Results For Oil of Table 1 Top Treated With Various Titanium Additives

| Sample No. | Oil in blend (wt. %) | Metal compound (wt. %) | metal (ppm) | TEOST (milligrams) |
|---|---|---|---|---|
| 8 | 100 | 0 | 0 | 39.4 |
| 9 | 99.80 | 0.20 | 98.0 | 31.7 |
| 10 | 99.84 | 0.16 | 97.4 | 20.7 |
| 11 | 99.78 | 0.22 | 100.5 | 32.3 |
| 12 | 99.51 | 0.49 | 100.0 | 26.4 |

In the foregoing Table 6, the oxidation stability of base oils containing other hydrocarbon soluble metal compounds (samples 9-14) were compared to the oxidation stability of the base oil (sample 8) used in the samples 9-14. The base oil of samples 8-14 was similar to the base oil used in samples 1-7 above.

In this example, sample 9 used titanium IV 2-propanolato, tris iso-octadecanoato-O that contained about 5.5 wt. % titanium metal as the hydrocarbon soluble titanium compound. Sample 10 used titanium IV 2,2(bis 2-propeno-latomethyl) butanolato, tris neodecanoato-O that contained about 5.8 wt. % titanium metal as the hydrocarbon soluble titanium compound. Sample 11 used titanium IV 2-propanolato, tris(dioctyl)phosphato-O that contained about 3.1 wt. % titanium metal in the compound. Sample 12 used titanium IV 2-propanolato, tris(do-decyl)benzenesulfanato-O that contained about 3.5 wt. % titanium metal in the titanium compound. Each of the titanium compounds in samples 9-12 is available from Kenrich Petrochemicals, Inc. of Bayonne, N.J.

As illustrated by the foregoing results, samples 2-14 containing from about 50 to about 800 ppm titanium metal in the form of a hydrocarbon soluble titanium compound significantly outperformed a conventional lubricant composition containing no hydrocarbon soluble titanium compound. Sample 1 containing no hydrocarbon soluble titanium compound had a TEOST result of 39.4 milligrams whereas the other samples (2-12) containing titanium had TEOST results ranging from about 20 to about 29.9 milligrams. It is expected that formulations containing from about 50 to about 800 ppm titanium metal in the form of a hydrocarbon soluble titanium compound will enable a reduction in conventional phosphorus and sulfur antiwear agents thereby improving the performance of pollution control equipment on vehicles while achieving a similar or improved antioxidant performance or benefit.

EXAMPLE 5

Wear Reducing Effects of Hydrocarbon Soluble Titanium Compounds

Thirteen fully formulated lubricant compositions were made and the wear properties of the compositions were compared using a four ball wear test according to European test code IP-239. Each of the lubricant compositions contained a conventional DI package providing 11 percent by weight of the lubricant composition. The DI package contained conventional amounts of detergents, dispersants, antiwear additives, friction modifiers, antifoam agents, and antioxidants. The formulations also contained about 0.1 percent by weight pour point depressant, about 11.5 percent by weight olefin copolymer viscosity index improver, about 62 to 63 percent by weight 150 solvent neutral oil, about 14.5 percent by weight 600 solvent neutral oil. Sample 13 contained no titanium compound. Samples 14-25 contained titanium compounds in amounts sufficient to provide about 80 to about 200 ppm titanium metal. The samples was tested in the lubricant formulation using a four ball wear test at room temperature, for 60 minutes at an rpm of 1475 using a 40 kilogram weight. The formulations and results are given in the following table.

TABLE 7

| Component | Sample 13 | Sample 14 | Sample 15 | Sample 16 | Sample 17 | Sample 18 | Sample 19 | Sample 20 | Sample 21 | Sample 22 | Sample 23 | Sample 24 | Sample 25 |
|---|---|---|---|---|---|---|---|---|---|---|---|---|---|
| DI Package | 11.0 | 11.0 | 11.0 | 11.0 | 11.0 | 11.0 | 11.0 | 11.0 | 11.0 | 11.0 | 11.0 | 11.0 | 11.0 |
| Ti-TEN CEN | — | 0.170 | 0.340 | — | — | — | — | — | — | — | — | — | — |
| Ti-2-EHO | — | — | — | 0.115 | 0.230 | — | — | — | — | — | — | — | — |
| KR-TTS | — | — | — | — | — | 0.183 | 0.336 | — | — | — | — | — | — |
| LICA-01 | — | — | — | — | — | — | — | 0.173 | 0.346 | — | — | — | — |
| KR-12 | — | — | — | — | — | — | — | — | — | 0.327 | 0.654 | — | — |
| KR-9S | — | — | — | — | — | — | — | — | — | — | — | 0.287 | 0.575 |

TABLE 7-continued

| Component | Sample 13 | Sample 14 | Sample 15 | Sample 16 | Sample 17 | Sample 18 | Sample 19 | Sample 20 | Sample 21 | Sample 22 | Sample 23 | Sample 24 | Sample 25 |
|---|---|---|---|---|---|---|---|---|---|---|---|---|---|
| PPD | 0.100 | 0.100 | 0.100 | 0.100 | 0.100 | 0.100 | 0.100 | 0.100 | 0.100 | 0.100 | 0.100 | 0.100 | 0.100 |
| Viscosity index improver | 11.5 | 11.5 | 11.5 | 11.5 | 11.5 | 11.5 | 11.5 | 11.5 | 11.5 | 11.5 | 11.5 | 11.5 | 11.5 |
| ESSO 150 solvent neutral oil | 62.90 | 62.73 | 62.56 | 62.78 | 62.67 | 62.72 | 62.53 | 62.73 | 62.55 | 62.57 | 62.25 | 62.61 | 62.32 |
| ESSO 600 solvent neutral oil | 14.50 | 14.50 | 14.50 | 14.50 | 14.50 | 14.50 | 14.50 | 14.50 | 14.50 | 14.50 | 14.50 | 14.50 | 14.50 |
| Total | 100 | 100 | 100 | 100 | 100 | 100 | 100 | 100 | 100 | 100 | 100 | 100 | 100 |
| Ti (ppm) | 0 | 87 | 167 | 100 | 196 | 91 | 176 | 105 | 205 | 101 | 198 | 102 | 202 |
| 4 ball wear test | 0.65 | 0.42 | 0.46 | 0.47 | 0.46 | 0.37 | 0.44 | 0.34 | 0.40 | 0.44 | 0.42 | 0.48 | 0.37 |

In the above table, the following legend is used:

Ti-TEN CEN is a titanium neodecanoate from OM Group, Inc. of Newark, N.J. and contains about 6.7% by weight titanium metal.

Ti-2-EHO is titanium 2-ethylhexoxide containing about 8.7% by weight titanium metal.

KR-TTS is titanium IV 2-propanolato, tris isooctadecanoato-O from Kenrich Petrochemicals, Inc. of Bayonne, N.J. and contains about 5.5% titanium metal.

LICA-01 is titanium IV 2,2(bis 2-propenolatomethyl)butanolato, tris neodecanoato-O from Kenrich Petrochemicals, Inc. and contains about 5.8% titanium metal.

KR-12 is titanium IV 2-propanolato, tris(dioctyl)phosphato-O, from Kenrich Petrochemicals, Inc. and contains about 3.1% titanium metal.

KR-9S is titanium IV 2-propanolato, tris(dodecyl)benzenesulfanato-O, from Kenrich Petrochemicals, Inc. and contains about 3.5% titanium metal.

PPD is a pour point depressant.

As illustrated by the foregoing results, samples 14-25 containing from about 80 to about 200 ppm titanium metal in the form of a hydrocarbon soluble titanium compound significantly outperformed a conventional lubricant composition containing no titanium metal. Sample 13 containing no titanium metal had a wear scar diameter of about 0.65 millimeters whereas the other samples containing titanium had wear scar diameters ranging from about 0.35 to about 0.47 millimeters. It is expected that fonnulations containing from about 50 to about 500 ppm titanium metal in the form of a hydrocarbon soluble titanium compound will enable a reduction in conventional phosphorus and sulfur antiwear agents thereby improving the performance of pollution control equipment on vehicles while achieving a similar antiwear performance or benefit.

At numerous places throughout this specification, reference has been made to a number of U.S. Patents and publications. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A fully formulated lubricating oil composition comprising at least one succinimide dispersant derived from a polyalkylene compound having from about 50 to about 85% vinylidene double bonds in the compound, a metal containing detergent, at least one wear reducing agent, at least one antioxidant, and a hydrocarbon soluble titanium compound as a friction modifier, wherein the lubricating oil composition is substantially free of molybdenum compounds, and wherein the hydrocarbon soluble titanium compound comprises a reaction product of titanium alkoxide and a carboxylic acid selected from the group consisting of a non-linear monocarboxylic acid and a carboxylic acid having more than 22 up to 25 carbon atoms.

2. The composition of claim 1, wherein the metal containing detergents are selected from the group consisting of calcium phenates, calcium salicylates, calcium sulfonates, magnesium phenates, magnesium salicylates, magnesium sulfonates, and mixtures thereof.

3. The composition of claim 1, wherein the detergent is an overbased calcium sulfonate.

4. The composition of claim 1, wherein the detergent is an overbased magnesium sulfonate.

5. The composition of claim 1, wherein the titanium from a titanium compound is present in an amount of about 10 ppm to about 500 ppm.

6. The composition of claim 1, wherein said carboxylic acids are selected from the group consisting essentially of cyclohexanecarboxylic acid, phenylacetic acid, benzoic acid, neodecanoic acid, and mixtures thereof.

7. The composition of claim 6, wherein said titanium compound comprises a reaction product of titanium isopropoxide and neodecanoic acid.

8. The composition of claim 1 wherein said titanium compound comprises a compound substantially devoid of sulfur and phosphorus atoms.

9. The composition of claim 1, wherein the wear reducing agent comprises at least one metal dihydrocarbyl dithiophosphate compound wherein the metal of the at least one metal dihydrocarbyl dithiophosphate metal compound is selected from the group consisting of an alkali metal, an alkaline earth metal, aluminum, lead, tin, molybdenum, manganese, nickel, copper, titanium, and zinc.

10. The composition of claim 1, wherein the friction modifier is present in an amount ranging from about 0.20 wt. % to about 2.0 wt. %, based on the total weight of the composition.

11. The composition of claim 1, further comprising a second friction modifier selected from the group consisting of metal-free ester compounds and nitrogen containing compounds.

12. The composition of claim 11, wherein the friction modifier comprises a compound selected from the group consisting of alkoxylated amines, alkoxylated ether amines, and thiadiazoles.

13. The composition of claim 11, wherein the friction modifier comprises glycerol monooleate.

14. The composition of claim 1, wherein said composition contains from about 0.025 wt. % to less than about 0.1 wt. % phosphorus.

15. The composition of claim 14, wherein said composition contains from about 0.025 wt. % to about 0.075 wt. % phosphorus.

16. A method for reducing engine sludge of an internal combustion engine, which comprises: (1) adding to the engine the lubricating oil composition of claims 1; and (2) operating said engine.

17. A lubricated surface comprising a lubricant composition containing a base oil of lubricating viscosity and an additive package comprising at least one succinimide dispersant derived from a polyalkylene compound having from about 50 to about 85% vinylidene double bonds in the compound, a metal containing detergent, at least one wear reducing agent, at least one antioxidant, and a hydrocarbon soluble titanium compound as a friction modifier, wherein the lubricant composition is substantially free of molybdenum compounds, and wherein the hydrocarbon soluble titanium compound comprises a reaction product of titanium alkoxide and a carboxylic acid selected from the group consisting of a non-linear mono-carboxylic acid and a carboxlic acid having more than 22 up to 25 carbon atoms.

18. The lubricated surface of claim 17, wherein the lubricated surface comprises an engine drive train.

19. The lubricated surface of claim 17, wherein the lubricated surface comprises an internal surface or component of an internal combustion engine.

20. The lubricated surface of claim 17, wherein the lubricated surface comprises an internal surface or component of a compression ignition engine.

21. The lubricated surface of claim 17, wherein the detergent comprises a material selected from the group consisting of calcium phenates, calcium salicylates, calcium sulfonates, magnesium phenates, magnesium salicylates, magnesium sulfonates, and mixtures thereof.

22. The lubricated surface of claim 17, wherein the friction modifier comprises a metal-free friction modifier selected from the group consisting of glycerol esters and amine compounds.

23. A motor vehicle comprising the lubricated surface of claim 17.

24. A vehicle having moving parts and containing a lubricant for lubricating the moving parts, the lubricant comprising an oil of lubricating viscosity and an additive package comprising at least one succinimide dispersant derived from a polyalkylene compound having from about 50 to about 85% vinylidene double bonds in the compound, a metal containing detergent, at least one wear reducing agent, at least one antioxidant, and a hydrocarbon soluble titanium compound as a friction modifier, wherein the lubricant is substantially free of molybdenum compounds, and wherein the hydrocarbon soluble titanium compound comprises a reaction product of titanium alkoxide and a carboxylic acid selected from the group consisting of a non-linear mono-carboxylic acid and a carboxlic acid having more than 22 up to 25 carbon atoms.

25. The vehicle of claim 24, wherein the friction modifier comprises a metal-free friction modifier selected from glycerol esters and amine compounds.

26. The vehicle of claim 24, wherein the moving parts comprise a heavy duty diesel engine.

27. A fully formulated lubricant composition comprising a base oil component of lubricating viscosity and an amount of sludge reducing lubricant additive wherein the lubricant additive comprises at least one succinimide dispersant derived from a polyalkylene compound having from about 50 to about 85% vinylidene double bonds in the compound, a metal containing detergent, at least one wear reducing agent, at least one antioxidant, and a hydrocarbon soluble titanium compound as a friction modifier providing from about 10 to about 500 ppm titanium to the lubricant composition, wherein the lubricant composition is substantially free of molybdenum compounds, and wherein the hydrocarbon soluble titanium compound comprises a reaction product of titanium alkoxide and a carboxylic acid selected from the group consisting of a non-linear mono-carboxylic acid and a carboxlic acid having more than 22 up to 25 carbon atoms.

28. The lubricant composition of claim 27, wherein the lubricant composition comprises a low ash, low sulfur, and low phosphorus lubricant composition suitable for compression ignition engines.

29. The lubricant composition of claim 27, wherein the phosphorus content ranges from about 250 to about 500 ppm in the lubricant composition.

30. The lubricant composition of claim 27, wherein the friction modifier comprises a metal-free friction modifier selected from glycerol esters and amine compounds.

31. A lubricant additive concentrate for providing reduced sludge in a lubricant composition. the concentrate begin devoid of molybdenum and comprising a hydrocarbyl carrier fluid, at least one succinimide dispersant derived from a polyalkylene compound having from about 50 to about 85% vinylidene double bonds in the compound, and a hydrocarbon soluble titanium compound as a friction modifier providing from about 10 to about 500 ppm titanium to the lubricant composition, wherein the hydrocarbon soluble titanium compound comprises a reaction product of titanium alkoxide and a carboxylic acid selected from the group consisting of a non-linear mono-carboxylic acid and a carboxlic acid having more than 22 up to 25 carbon atoms.

32. A lubricant composition comprising a base oil and the additive concentrate of claim 31.

33. An engine lubricant composition containing a base oil of lubricating viscosity and an amount of at least one hydrocarbon soluble titanium compound effective to provide improved lubricant properties selected from the group consisting of a reduction in engine surface wear greater than a surface wear of a lubricant composition devoid of the hydrocarbon soluble titanium compound, a reduction in oxidation of the lubricant composition in the engine greater than a reduction in oxidation of the lubricant composition devoid of the hydrocarbon soluble titanium compound, and a reduction in engine sludge formation in the lubricant composition greater than a reduction in sludge formation in the lubricant composition devoid of the hydrocarbon soluble titanium compound, wherein the hydrocarbon soluble titanium compound comprises a reaction product of titanium alkoxide and a carboxylic acid selected from the group consisting of a non-linear mono-carboxylic acid and a carboxlic acid having more than 22 up to 25 carbon atoms.

34. The lubricant composition of claim 33, wherein the amount of hydrocarbon soluble titanium compound provides an amount of titanium ranging from above about 1 to about 1000 ppm in the lubricant composition.

35. The lubricant composition of claim 33, wherein the hydrocarbon soluble titanium compound is substantially devoid of phosphorus and sulfur atoms.

36. The lubricant composition of claim 33, wherein the hydrocarbon soluble titanium compound comprises a reaction product of titanium alkoxide and a mono-carboxylic acid containing at least about 6 carbon atoms and having a secondary, or tertiary carbon adjacent to a carboxyl group.

37. A motor vehicle containing the lubricant composition of claim 33.

* * * * *